United States Patent [19]

Fischer

[11] Patent Number: 4,520,729

[45] Date of Patent: Jun. 4, 1985

[54] INKER FOR ROTARY PRINTING MACHINE, AND METHOD

[75] Inventor: Hermann Fischer, Augsburg, Fed. Rep. of Germany

[73] Assignee: M.A.N.-Roland Druckmaschinen Aktiengesellschaft, Offenbach am Main, Fed. Rep. of Germany

[21] Appl. No.: 575,856

[22] Filed: Feb. 1, 1984

[30] Foreign Application Priority Data

Feb. 5, 1983 [DE] Fed. Rep. of Germany ..... 3303988

[51] Int. Cl.[3] ..... B41F 31/36; B41L 27/32

[52] U.S. Cl. ..... 101/352

[58] Field of Search ..... 101/349, 350, 351, 352, 101/363, 148, 359–362, 356–358, 205–209

[56] References Cited

U.S. PATENT DOCUMENTS

| | | | |
|---|---|---|---|
| 2,436,455 | 2/1948 | Seybold | 101/350 |
| 3,150,589 | 9/1964 | Senogles | 101/349 X |
| 4,129,077 | 12/1978 | Fischer | 101/DIG. 6 |
| 4,350,094 | 9/1982 | Fischer | 101/350 |
| 4,361,090 | 11/1982 | Klingler et al. | 101/350 |

FOREIGN PATENT DOCUMENTS

| | | | |
|---|---|---|---|
| 0035735 | 9/1981 | European Pat. Off. | 101/349 |

*Primary Examiner*—J. Reed Fisher

*Attorney, Agent, or Firm*—Frishauf, Holtz, Goodman & Woodward

[57] ABSTRACT

To permit, selectively, thicker or thinner ink films being transferred from an inker supply (1, 2) having a doctor blade (2) to a plate cylinder (10) via ink application rollers (8, 9) and an ink roller train, without readjustment of the position of the doctor blade (2) with respect to the ink roller (1), the ink roller train has a main train of ink rollers, and auxiliary trains or sets of paired ink rollers, the main ink roller train being so arranged that some of the rollers can be physically shifted to define a gap in the ink transfer path through the main roller train, and, instead, the gap is bridged by rollers of the auxiliary roller train (B). Inserting more rollers, serially, in the path of ink between the ink roller (1) and the plate cylinder (10) provides for a thin film of ink for offset printing; a lesser number of rollers provides a thick film of ink, for example for use in di-litho printing.

5 Claims, 2 Drawing Figures

INKER FOR ROTARY PRINTING MACHINE, AND METHOD

The present invention relates to an inker for a rotary printing machine, and more particularly for a lithographic-type printing machine which is operable either in offset mode or direct lithographic printing mode, also known as the "di-litho" printing method.

BACKGROUND

When operating printing machines in various printing modes, it is frequently necessary to readjust the quantity of ink which is being supplied from an ink supply source to the plate cylinder of the printing machine. Lithographic printing machines which are operable either in the offset mode of printing or for di-litho printing require differences in the thickness of the ink film supplied by the inker. For offset printing, a very thin layer of ink is desirable and suitable. The ink is transferred from the plate cylinder to a somewhat yielding blanket or rubber cylinder, and thus ink will be supplied to all areas of paper which is to be printed, being capable of entering even small depressions and pores of the paper due to the yielding nature of the rubber blanket cylinder. In di-litho printing, however, ink is supplied from the hard plate directly to the ink-receiving web on which printing is to be carried out, typically paper. Di-litho printing thus requires a thicker layer of ink, particularly if paper is to be printed on which does not have a smooth surface. The yielding rubber surface of the blanket cylinder is not available, and print, directly, must be supplied from the hard plate to the paper. Thin layers of ink thus may not reach all depressions within the paper surface so that the printed subject matter may not be completely transferred from the plate cylinder, as desired.

In order to accomodate different printing modes, it has previously been the practice to readjust the doctor blade of an ink supply system for the different types of printing modes to be accomodated by the printing machine. It is difficult to readjust the doctor blade, and to obtain a precise positioning thereof after readjustment, and, for example at a later date, to again reposition the blade to establish a previously used ink film.

Usually, inkers have a plurality of serially arranged ink transport rollers, some of which may be oscillating or milling rollers, to provide an ink roller train, in which the ink is, at the end, applied to one or more ink application rollers which are in contact with the plate cylinder. An inker of this type is shown, for example, in German Examined Published Application DE-AS No. 27 03 425 of which U.S. Pat. No. 4,148,256, by the inventor hereof corresponds.

THE INVENTION

It is an object to provide an inker in which the thickness of the ink film being transferred through the inker to the plate cylinder of a printing machine can be changed without changing or resetting a doctor blade with respect to a ductor or ink roller, so that the nip between the blade and the roller can be maintained.

Briefly, the inker is so arranged that the number of rollers within an ink train is variable. Thus, in accordance with a feature of the invention, auxiliary inker train rollers in roller pairs can be placed, serially, in the train of ink transfer or transmission roller chain or train. The standard or regular ink transfer roller train, then, is so arranged that ink rollers are in contact with each other, to provide for through-transfer of ink from the ink supply to the plate cylinder; or, selectively, may be relocated to form a gap with a next adjacent roller, and, instead, provide for ink transmission via auxiliary rollers, typically roller pairs, so that insertion of the additional or auxiliary rollers lengthens the ink transfer path, thus decreasing the thickness of the film of ink which is being supplied to the plate cylinder while maintaining the direction of rotation of the rollers of the standard or regular ink transfer roller train.

DRAWINGS

FIG. 1 is a schematic side view of an inker in accordance with the present invention, arranged and set up for supplying ink with minimum thickness of the ink film; and FIG. 2 is the same inker, adjusted and arranged for supplying an ink film which is thicker than that of the system of FIG. 1.

DETAILED DESCRIPTION

Figure 1:
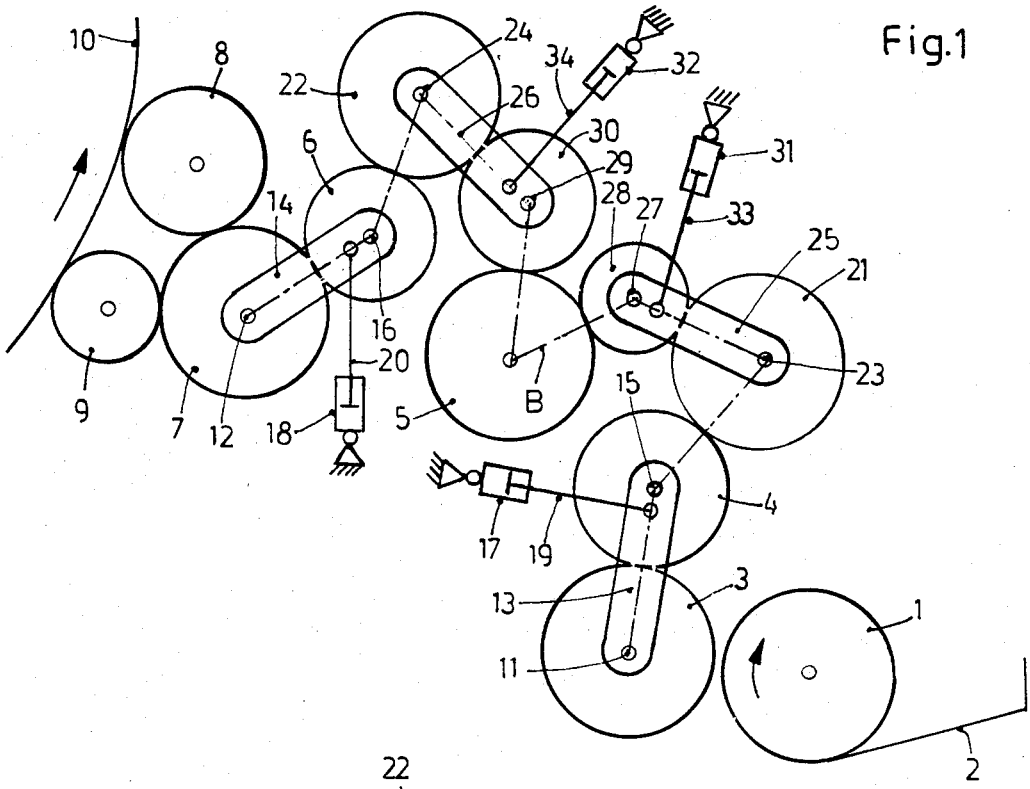

The inker has an ink trough or ink ductor roller 1, which operates within an ink trough (not shown) and against which a blade 2 can be placed, in a predetermined adjustment. The ink roller—blade combination can be of any standard and suitable construction, as well known. Ink derived from the roller 1, driven at a slow speed, is transferred over five ink transfer rollers 3, 4, 5, 6, 7—see FIG. 2. The last one of the ink transfer rollers within the ink train of rollers 3–7, that is, roller 7, is in ink transfer contact with ink application rollers 8, 9, which supply ink to the plate of a plate cylinder 10. Suitably, alternate rollers of the ink roller train, that is, rollers 3, 5, 7, have a metallic, hard surface and are formed as milling rollers, that is, they are arranged for axial oscillation. The intervening engaging rollers 4, 6, as well as the application rollers 8, 9 may then be supplied with a soft or non-metallic surface. A gap is shown between rollers 1 and 3 which, however, is purely schematic and for illustration. The respective location of rollers 1 and 3 is such that ink is transferred from roller 1 to roller 3.

In accordance with a feature of the invention, the ink roller train can be changed to interrupt engagement between rollers 4 and 5, and between rollers 6 and 5, and, instead, introduce auxiliary roller pairs 21, 28 and 30, 22 instead, in contact with rollers 4 and 5, and 5 and 6, respectively. The rollers 3, 4 and 6, 7 have shaft stubs 11, 15 and 16, 12, respectively (FIG. 1) which are journalled in pivotable levers 13, 14, so that the rollers 3, 4 and 6, 7 form roller pairs. Suitably, the inker rollers 3, 5, 7 are driven at a surface speed which, preferably, is similar to the surface speed of the plate cylinder 10. The inker rollers 4, 6 as well as the application rollers 8, 9 need not be driven; they are then carried along by friction. Hydraulic cylinders 17, 18, coupled to positioning rods 19, 20, are provided to selectively change the position of the links 13, 14, and hence the position of the rollers 4, 6. The links 13, 14 pivot about the axes of rotation of the rollers 3, 7, respectively; the shaft positions of shafts 11, 12 are fixed in the frame of the machine.

Additional or auxiliary roller train elements, formed by rollers 21, 22, are provided, in accordance with a feature of the invention, which, as shown in FIG. 1, can be selectively engaged with the rollers 4, 6, respectively, as shown in FIG. 1. The additional or auxiliary rollers 21, 22 have shaft stubs 23, 24 which are congruent with the axes of rotation of the rollers 21, 22. The shaft stubs are journalled in levers 25, 26. The shaft stubs are fixed in the frame of the machine (not shown). Stub shaft 27 of a further additional or auxiliary roller-train roller 28 is journalled on the lever 25; stub shaft 29 of an additional or auxiliary roller 30 is journalled on the lever 26. Levers 25, 26 can be provided about the axes of the rollers 21, 22 by operation of hydraulic cylinders 31, 32 via connecting rods 33, 34.

Figure 2:
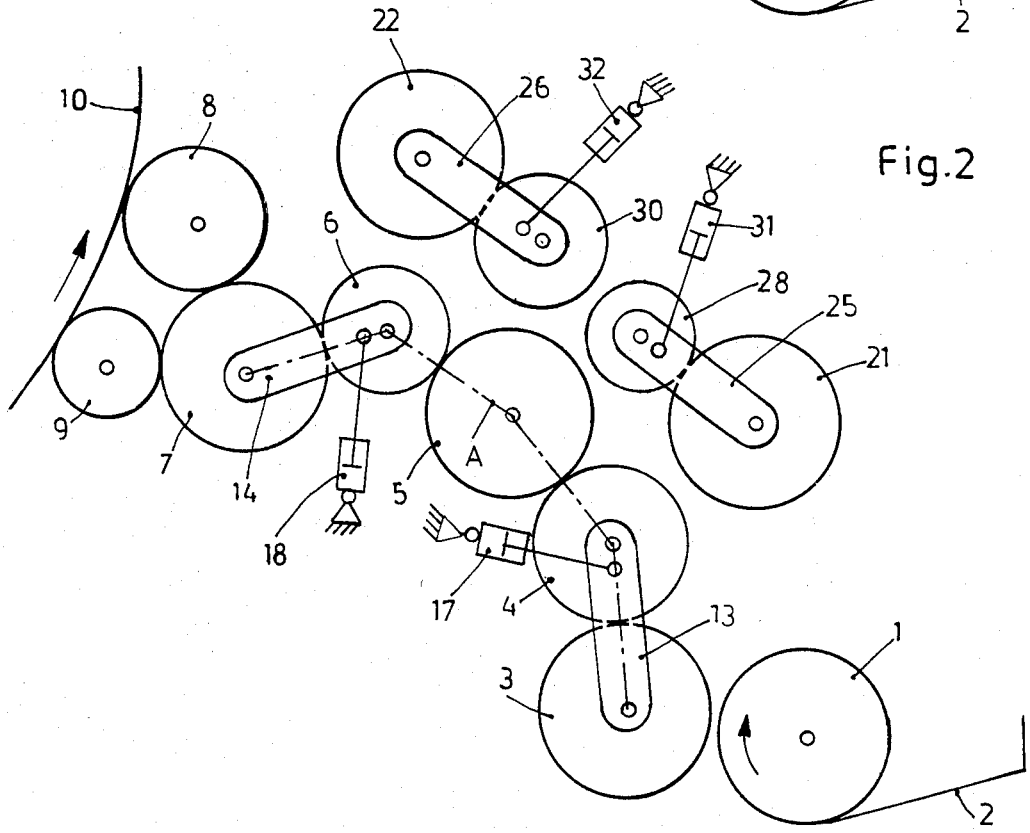

FIGS. 1 and 2 illustrate the arrangement at one side. Of course, levers, shafts and shaft stubs will be similarly arranged at the other axial ends of the respective rollers, which, also, may have hydraulic operating cylinders coupled thereto, and be operated similarly and preferably in synchronism with the respective hydraulic cylinders shown in FIGS. 1 and 2.

OPERATION

Upon controlling of the respective hydraulic cylinders 17, 18, 31, 32 such that rollers 3, 4, 5, 6, 7 form a continuous roller train, ink will be transferred in accordance with the chain-dotted line A from the ink supply roller 1 to the application rollers 8, 9. Ink, thus, will be transferred via five rollers to the application rollers 8, 9, thus supplying a comparatively thick film of ink. This is the setting for, example, di-litho printing. This arrangement may, however, also be used in offset printing if the printed surface requires heavy inking, for example if large continuous "black" or ink-accepting surfaces are to be printed.

If the printer requires a thinner film of ink, hydraulic cylinders 17, 18, 31, 32 are operated to change the positions of the respective links from that shown in FIG. 2 to that shown in FIG. 1. The roller 6 is lifted off roller 5, so that a gap arises therebetween, the roller 6 then engaging the auxiliary ink train roller 22. Similarly, roller 4 is separated from roller 5 to form a gap therewith and, instead, brought into engagement with the auxiliary ink train roller 21. The gaps which arise between rollers 4 and 5 and between rollers 6 and 5, respectively, are thus bridged by the auxiliary ink train roller pairs 21, 28 and 30, 22, respectively. The additional or auxiliary ink train rollers 28, 30 are pivoted about the axis of rollers 21, 22 by the hydraulic cylinders 31, 34 such that the rollers 28, 30 come into engagement with roller 5. The ink transport path then will be along the chain-dotted line B (FIG. 1) which, as can readily be seen, includes four additional rollers, and thus provides a substantially longer transport path of the ink. Each gap between the rollers 4, 5 thus is bridged by the additional roller train elements. In the longer transport path, again, and alternatingly, a roller with a hard surface and one with a softer surface can be used; in the example shown, if roller 3 has a hard surface, rollers 21 and 22 will, likewise, have a hard surface, the hard-surface roller 5 then being in engagement with yielding-surface rollers 28, 30, and the hard-surface rollers 21, 22 will be in engagement with the yielding-surface rollers 4, 6.

The invention, thus, permits change of the thickness of the ink film being transported by the inker without changing the position of the doctor blade 2, and merely by insertion or exclusion of additional ink train rollers 21, 28, which are paired, and/or 22, 30, respectively. The doctor blade 2 then is used only for fine adjustment of the thickness of the ink film within the range of the thickness of ink being transported by the respective number of rollers. The system, thus, prevents undesired tampering by printing personnel with the adjustment of the doctor blade 2, and thus is intended to avoid that the printer will try to open the nip between the blade 2 and the roller 1 to such an extent that the film thickness being applied to the roller 3—which rotates at a substantially higher speed than the roller 1, namely, preferably, the circumferential speed of plate cylinder 10, will be so great that the ink will spray off or sling off the roller 3.

The system, in accordance with a feature of the invention, permits adjustment merely by engagement of selective roller pairs, within three ranges, namely for a very thin, an intermediate, and a thicker film of ink. For example, the additional roller pair 22, 30 and the pair of rollers 6, 7 are placed in the position shown in FIG. 1, whereas the roller pair 3, 4 will remain in engagement with the roller 5, as shown in FIG. 2. Selective operation of the respective hydraulic cylinders 18, 32, thus, permits an intermediate adjustment of the number of rollers which are effective in the roller train of the inker.

Various changes and modifications may be made, and the invention is not restricted to the specific example shown. It is possible not only to interrupt the basic ink transfer path at two points—namely by gaps between rollers 4, 5, and 6, 5, respectively; the basic inker roller train, shown for example by line A in FIG. 2, may be rearranged to permit interruption at three points to form three gaps which, then, are bridged by an auxiliary roller train arrangement which has one, or two—as shown—or more roller pairs, inserted by way of an auxiliary path. The basic arrangement, thus, permits variations in different form, by introducing one or two or more roller pairs into the ink transport path to reduce the thickness of the ink film being supplied. The arrangement as shown, which changes the ink path by changing rollers, in pairs, has the advantage that the alternate placement of hard-surface or metallic-surface and yielding-surface rollers can be maintained; and that the direction of rotation of the rollers of the basic ink transfer path will not change.

I claim:

1. Inker for a rotary printing machine having a plate cylinder (10);

a ductor roller (1) and a doctor blade associated therewith;

at least one ink application roller (8, 9) in ink transmitting contact with the plate cylinder;

and an ink transfer roller train in ink transferring relation between the ductor roller (1) and the at least one application roller (8, 9), including a plurality of rollers in a serial path—in the direction of ink transfer—between the ductor and the at least one ink application roller, the ink transfer roller train including two rollers (4, 5; 6, 5) which are selectively positionable for surface engagement with each other, or for disengagement, and, when disengaged, defining a gap therebetween;

and comprising at least one pair of auxiliary or additional ink transfer rollers (21, 28; 22, 30) selectively engageable in serial, ink transfer position within the serial path of the rollers of the ink roller train;

one, each, of said at least one pair of additional or auxiliary rollers being selectively positionable for contact with one each respective roller of said two selectively positionable rollers of said roller train adjacent said gap to bridge the gap and transfer ink between the so separated rollers and thereby lengthen the ink transfer path through the roller train.

2. Inker according to claim 1, wherein the auxiliary or additional ink transfer rollers (21, 28; 22, 30) of the pair have different surface characteristics.

3. Inker for a rotary printing machine having a plate cylinder (10);

a ductor roller (1) and a doctor blade (2) associated therewith;

at least one ink application roller (8, 9) in ink-transferring contact with the plate cylinder;

an ink roller train, including a plurality of rollers serially arranged in serial ink-transferring relation between the ductor roller (1) and the at least one ink application roller (8, 9), in which the thickness of ink film being transported through the inker is controllable without adjustment of the doctor blade (2)—ductor roller (1) relationship, wherein two rollers, each (3, 4; 6, 7), of the roller train form a first group of paired rollers in continuous engagement with each other, and serially selectively engageable with another roller (5) of the roller train, or disengageable therefrom, and establishing an ink gap;

and an auxiliary roller train forming a second group of paired rollers, having at least two paired rollers (21, 28; 22, 30) is provided, selectively engageable with one of the rollers of the first paired groups and said another roller (5) to bridge the ink gap and form a serial part of the roller train, or disengageable from said first paired group, and out-of-engagement with said other roller.

4. Inker according to claim 3, wherein the two paired rollers of said roller groups have roller, shafts or axes (11, 15; 12, 16; 23, 27; 24, 29);

links (13, 14, 25, 26) are provided, pivotable about the shaft axis of one (11, 12, 23, 24) of the paired rollers of one of the groups, and retaining the shaft axes of the other one of the paired rollers of said one of the groups;

and selectively operable holding means (17, 18, 31, 32) are provided, engageable with the respective links to pivot the links, selectively, about their shaft axes and, thereby, permit selective engagement of the rollers secured to the links, or disengagement of said rollers secured to the links within the ink train.

5. Inker according to claim 4, wherein one of the rollers of the paired roller groups has a metallic surface, and the other roller of the paired roller groups has a yielding surface.

* * * * *